US006422965B1

(12) United States Patent
Balli et al.

(10) Patent No.: US 6,422,965 B1
(45) Date of Patent: Jul. 23, 2002

(54) DOOR OPERATOR UNIT

(75) Inventors: Robert E. Balli, Akron, OH (US); Charles E. Delaney, The Colony, TX (US)

(73) Assignee: Overhead Door Corporation, Dallas, TX (US)

( * ) Notice: Subject to any disclaimer, the term of this patent is extended or adjusted under 35 U.S.C. 154(b) by 0 days.

(21) Appl. No.: 09/553,614

(22) Filed: Apr. 20, 2000

(51) Int. Cl.[7] ..... E06B 9/74

(52) U.S. Cl. ..... 475/149; 475/156; 475/282; 160/310

(58) Field of Search ..... 475/149, 154, 475/156, 282; 160/310, 311, 312; 49/139, 140, 199

(56) References Cited

U.S. PATENT DOCUMENTS

| | | | | | |
|---|---|---|---|---|---|
| 1,649,797 | A | | 11/1927 | Winn, Jr. | 160/271 |
| 3,921,264 | A | | 11/1975 | Madonian et al. | 475/154 |
| 4,059,339 | A | * | 11/1977 | Brown | 160/310 X |
| 4,392,392 | A | | 7/1983 | Perisic et al. | 475/4 |
| 4,844,140 | A | | 7/1989 | Jones et al. | 160/310 |
| 5,083,600 | A | | 1/1992 | Weishar et al. | 160/310 |
| 5,203,392 | A | | 4/1993 | Shea | 160/7 |
| 5,245,879 | A | | 9/1993 | McKeon | 74/2 |
| 5,386,891 | A | | 2/1995 | Shea | 188/171 |
| 5,447,477 | A | | 9/1995 | Bresson et al. | 475/154 |
| 5,542,460 | A | | 8/1996 | McKeon | 160/7 |
| 5,547,009 | A | * | 8/1996 | Plumer | 160/310 |
| 5,673,514 | A | | 10/1997 | McKeon | 49/30 |
| 5,711,360 | A | | 1/1998 | Viotte | 160/310 |
| 5,799,716 | A | * | 9/1998 | Yamaguchi et al. | 160/310 |
| 5,924,949 | A | * | 7/1999 | Fan | 475/149 |

* cited by examiner

*Primary Examiner*—Charles A Marmor
*Assistant Examiner*—Ankur Parekh
(74) *Attorney, Agent, or Firm*—Gardere Wynne Sewell LLP

(57) ABSTRACT

A door operator unit includes a drive motor connected to a speed reduction differential planetary gear drive mechanism having a drive unit output shaft for connection to a further door drive mechanism. An electromagnetic brake is interposed between the motor output shaft and the planetary gear drive mechanism and is releasable when energized to allow rotation of the motor output shaft and the drive unit output shaft. A first ring gear of the planetary gear drive mechanism is normally held stationary by a release block and is operable in response to disengagement of the release block to permit rotation of the drive unit output shaft when the brake in engaged to allow manual opening and closing of the door. A torque limiting clutch may be interposed the operator unit output shaft and a second ring gear of the differential planetary gear drive mechanism.

28 Claims, 7 Drawing Sheets

FIG. 5
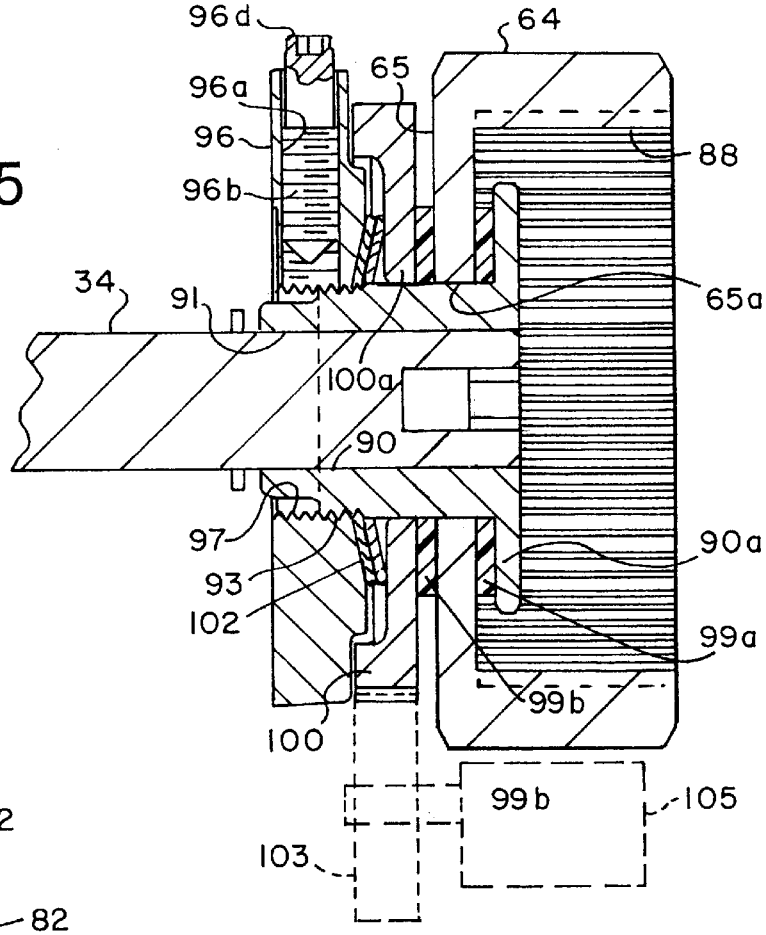
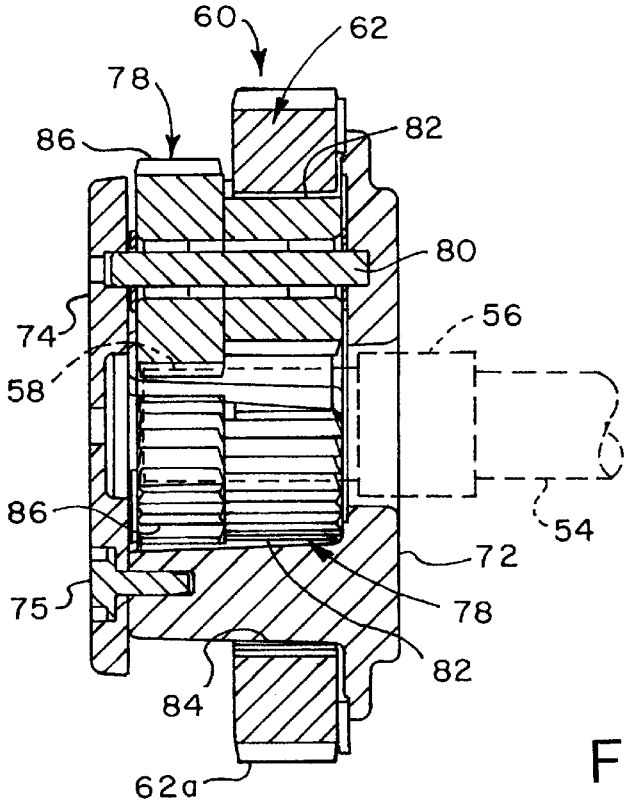
FIG. 6

DOOR OPERATOR UNIT

FIELD OF THE INVENTION

The present invention pertains to a motor-driven door operator unit for opening and closing an upward acting door, in particular, and including mechanism to permit manually closing the door under certain conditions.

BACKGROUND

Various types of apparatus have been developed for opening and closing large doors, including upward-acting garage doors and so-called rollup doors. Motor-driven operator units for industrial doors, including upward-acting doors of various types, have been developed which include mechanism for manually or automatically allowing the door to close under certain operating condition.

Various improvements have been sought in door operator units which are motor-driven but which also may be operated when motor power is unavailable or when the door is required to be closed under its own weight or another source of power. However, reliable and versatile operation of door operator units, compact and lightweight construction of such units and the ability to interchange the position of components of the operator unit, depending on the door configuration or application, continue to be problems facing artworkers. It is to these ends that the present invention has been developed.

SUMMARY OF THE INVENTION

The present invention provides an improved door operator unit, particularly of a type for opening and closing upward-acting, sectional and so-called rollup doors of various configurations.

In accordance with one aspect of the present invention, a motor driven door operator unit is provided which includes an improved power transmission mechanism between a drive motor and an operator unit output shaft. In particular, the power transmission mechanism includes a differential planetary gear drive drivenly connected to a drive motor and a remotely controlled brake operably connected to the motor output shaft for controlling rotation of the operator unit output shaft under certain operating conditions.

In accordance with another aspect of the invention, a door operator unit is provided which includes a differential planetary gear drive mechanism having a first ring gear which is normally held stationary to provide suitable speed reduction and torque amplification between a motor output shaft and the operator unit output shaft. A first ring gear member is held stationary during normal operation of the unit under motor power but may be released to rotate under certain operating conditions, such as when it is desirable to manually open or close a door connected to the operator unit. In this regard also, the releasable ring gear may be drivenly connected to a manual or separately driven shaft for driving the operator unit output shaft to rotate in either direction. Still further, the operator unit includes a release mechanism for holding the first ring gear stationary under selected operating conditions and for allowing the first ring gear to rotate, thus allowing rotation of the operator unit output shaft under other operating conditions.

The present invention also provides a door operator unit which includes a differential planetary gear drive mechanism having a first ring gear which may be held stationary or allowed to rotate and a second ring gear which also comprises an output gear of the operator unit. The second ring gear is operably connected to the operator unit output shaft through an adjustable torque limiting clutch whereby the output torque exerted on a door or door drive mechanism connected to the operator unit may be limited, and may be selectively adjusted.

The present invention provides an improved door operator unit drive mechanism which is adapted to include a gear for driving a sensor, such as a door position limit switch, which gear is positively keyed to rotate with the operator unit output shaft to prevent loss of timing between the position of the door and the limit switch.

Still further, an improved operator unit is provided which is adapted to reverse the positions of a manual operator drive shaft and a release mechanism. The operator unit includes an improved arrangement of a manually operated or auxiliary power operated drive shaft, associated drive mechanism and a speed limiting governor.

The present invention includes all of the above-mentioned features in a compact and reliable door operator unit, which will be further appreciated by those skilled in the art upon reading the detailed description which follows in conjunction with the drawing.

BRIEF DESCRIPTION OF THE DRAWINGS

FIG. 5 is a detail longitudinal central section view of the drive mechanism output ring gear and torque limiting clutch mechanism for the door operator unit;

FIG. 6 is a central longitudinal section view of the differential planetary gear speed reduction mechanism;

DETAILED DESCRIPTION OF A PREFERRED EMBODIMENT

Figure 1:
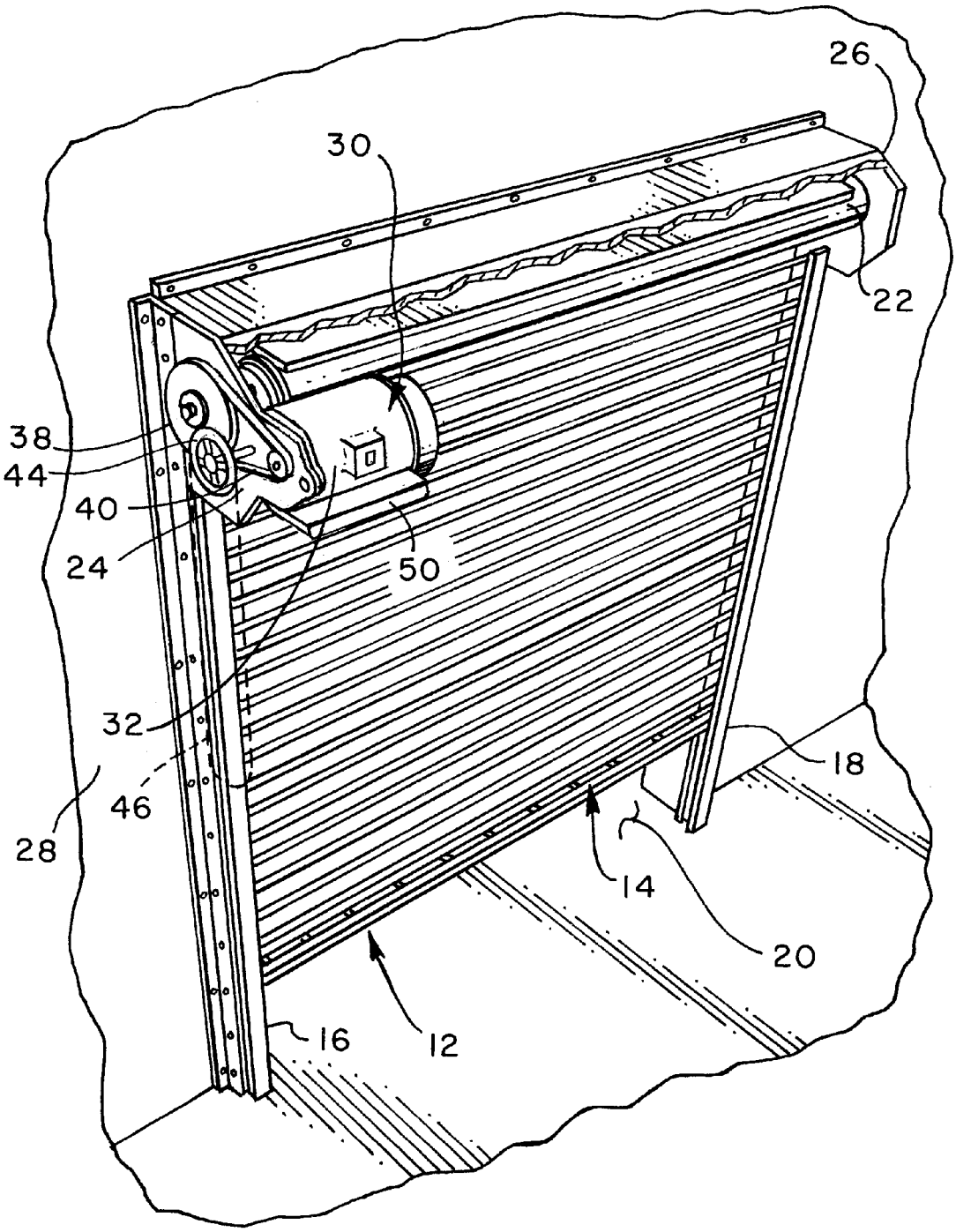
FIG. 1 is a perspective view of an industrial type, socalled rollup door drivenly connected to the improved door operator unit of the present invention.

In the description which follows, like parts are marked throughout the specification and drawing with the same reference numerals, respectively. The drawing figures may not necessarily be to scale and certain components may be shown in somewhat generalized form in the interest of clarity and conciseness.

Referring to FIG. 1, there is illustrated conventional upward acting or rollup type door 12 including a closure member 14 guided for movement between opposed vertically extending guide tracks 16 and 18 for closing a door opening 20. Upward acting door 14 is of a socalled rollup type and comprises a flexible curtain which is adapted to be wound around a cylinder or drum 22 supported for rotation between spaced apart brackets 24 and 26 suitably supported by a vertical wall 28, as shown. The drum 22 is drivenly connected to an improved door operator unit in accordance with the invention and generally designated by the numeral 30. The operator unit 30 includes a drive mechanism housing 32 adapted to be supported on the bracket 24 and may be supported in other configurations and on other structures, not shown. A rotatable output shaft 34 is supported for rotation on the housing 32 and supports a conventional drive sprocket 36 for rotation therewith and drivingly connected to a sprocket 38 connected to the drum 22 by way of a conventional endless chain 40. Shaft 34 is preferably of hexagonal or other polygonal cross section, as shown, to provide for improved drive connectability to components associated therewith.

Figure 2:
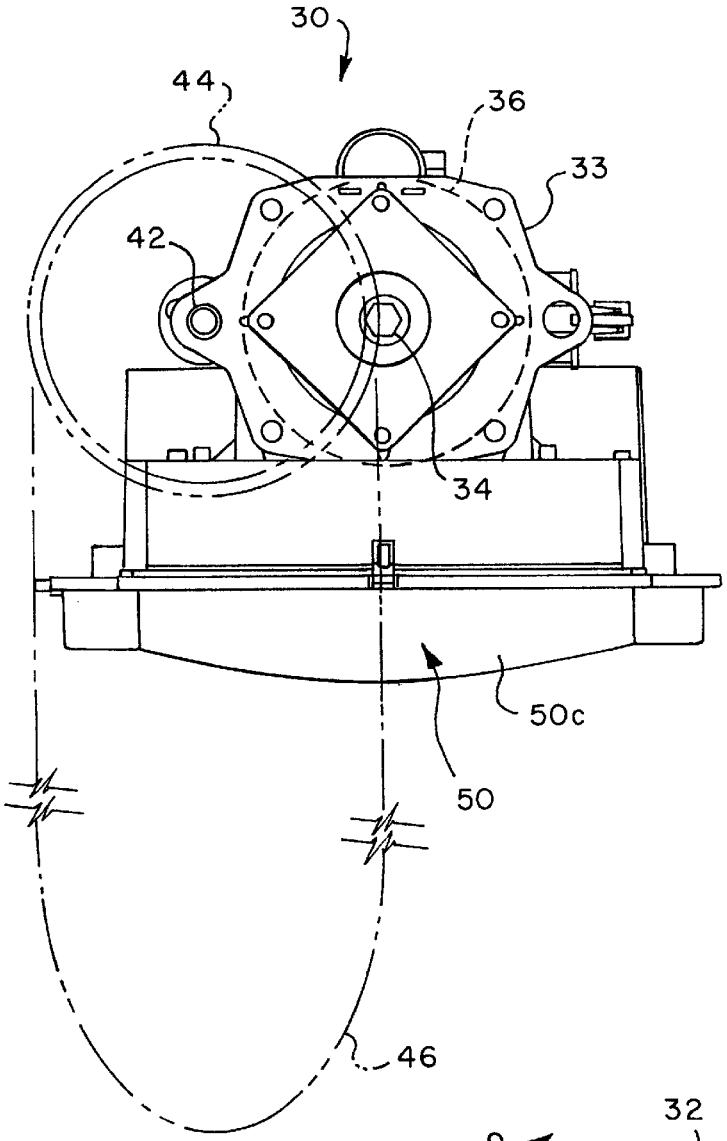
FIG. 2 is a front elevation of the door operator unit shown in FIG. 1.
Figure 3:
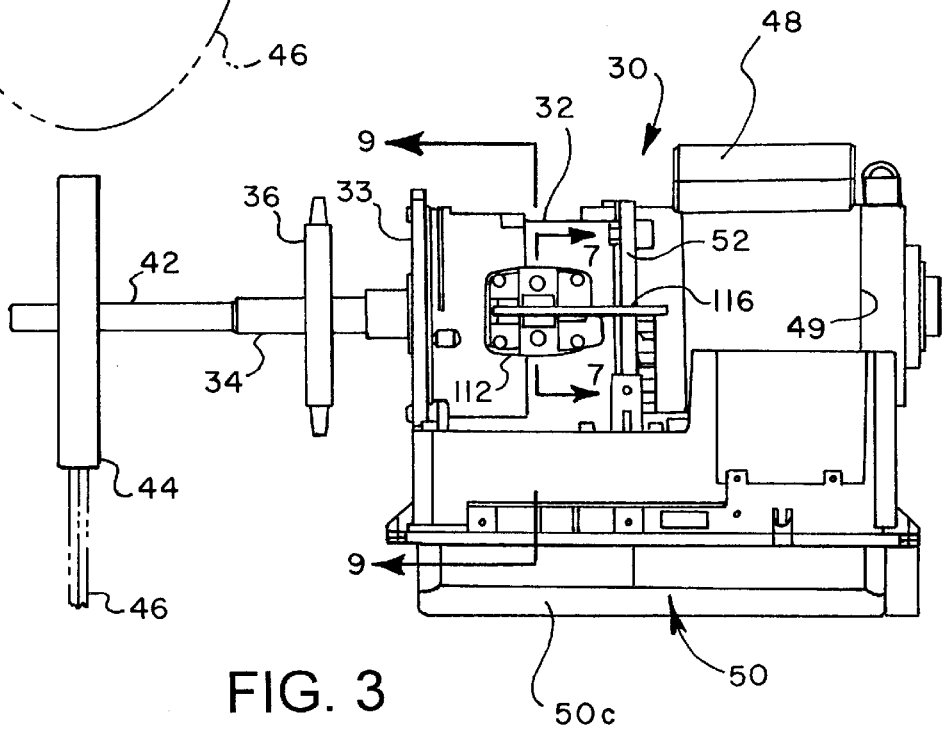
FIG. 3 is a side elevation of the door operator unit shown in FIGS. 1 and 2.

As shown in FIGS. 2 and 3 also, the door operator unit 30 includes an auxiliary drive shaft 42 rotatably supported on housing 32 spaced from output shaft 34 and supporting a handwheel 44 comprising a chain sprocket drivably engaged with an endless link chain 46 in a known manner for rotating shaft 42 to raise or lower the door 14, when required. Normally, in certain applications of the operator unit 30, the door 14 will lower itself under, certain conditions to be described hereinbelow but may be required to be raised manually by rotating the handwheel 44 via the chain 46 or by direct engagement of the handwheel by a person attempting to raise the door through the operator unit 30.

Referring further to FIGS. 2 and 3, the operator unit 30 includes an electric drive motor 48, FIG. 3, including a housing 49 directly connected to the housing 32 and operable through suitable drive mechanism to be described further herein to drive output shaft 34 in opposite directions of rotation under command of a control system, major components of which are mounted in a control system housing, generally designated by numeral 50. As further shown in FIGS. 2 and 3, housing 32 includes a suitable transverse mounting flange 33 for mounting the operator unit 30 on the bracket 24, for example, using conventional mechanical fasteners, not shown.

Figure 4:
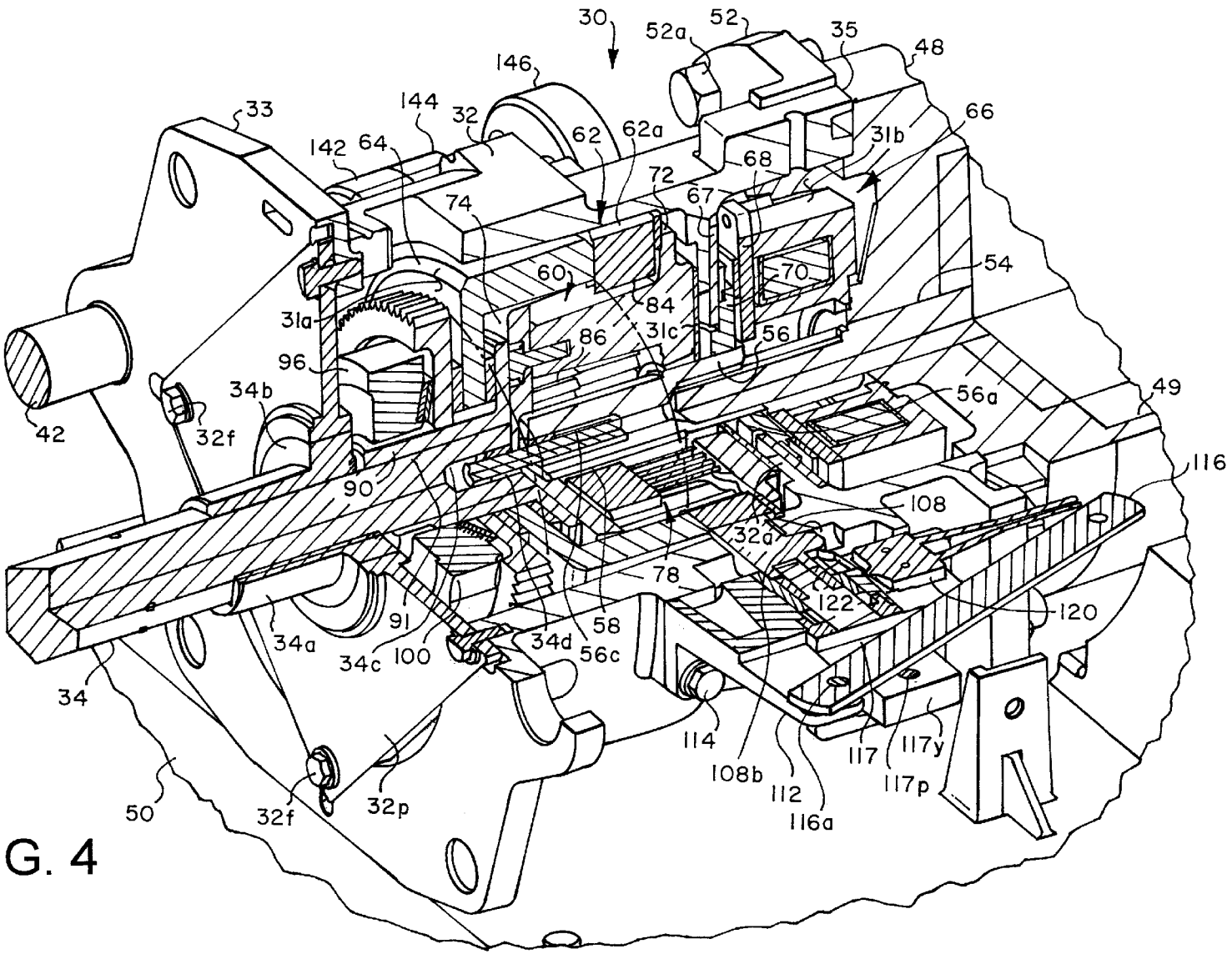
FIG. 4 is a perspective view, partially cut away, showing the drive mechanism and related elements of the door operator unit.

Referring now to FIG. 4, the housing 32 includes an endface 35 opposite the flange 33 and defined in part by a flange 52 for securing motor 48 in assembly with the housing 32 using conventional threaded fasteners 52a, one shown. Motor 48 may be a conventional induction type electric motor including a rotary output shaft 54 adapted to be drivably connected to a coupling member 56, including a "sun" gear 58 formed thereon. Sun gear 58 is drivingly connected to a differential planetary gear drive mechanism, generally designated by numeral 60 and disposed in a first cavity 31*a* formed in housing 32 and separated from a second cavity 31*b* by a transverse partition and brake mount 32*a*. Drive mechanism 60 includes a first ring gear 62 supported in housing 32 adjacent a second ring gear 64 comprising an output gear of the planetary gear drive mechanism.

Referring to FIG. 4, output shaft 34 is disposed in sleeved relationship within a bearing hub 34*a* which is coupled to a suitable sealed bearing 34*b* supported for rotation in a support plate 32*p* releasably connected to the flange 33 by suitable threaded fasteners 32*f*. Moreover, shaft 34 includes a bearing bore 34*c* for receiving an idler shaft 34*d* which extends within a bore 56*c* of coupling/sun gear 56, 58 to provide support for the coupling/sun gear and to journal the coupling/sun gear against lateral deflection away from its normal axis of rotation.

A commercially available electromagnetic disc type brake assembly 66 is supported within cavity 31*b* of housing 32 by motor housing 49 and includes a stator member 68 axially movable with respect to shaft 54 and coupling member 56 but non rotatable relative to housing 32. Brake assembly 66 may be of a type manufactured by API-Deltran, of Amherst, NY as their model BRP-30Y. A brake disc member 70 is mounted on coupling member 56 for rotation therewith and is operable to be engaged by an axially movable brake assembly stator member 68 to arrest rotation of coupling 56 and motor drive shaft 54 when the brake assembly 66 is de-energized. When brake assembly 66 is energized, stator member 68 is operable to release forcible engagement with brake disc 70 to allow same to rotate with motor drive shaft 54 and coupling/sun gear 56, 58. Brake assembly 66 includes a stationary back plate 67 forming a support for limiting axial movement of the disc 70 and stator 68 and to provide for engaging the disc 70 to provide the braking action. The coupling 56 includes a portion 56*a* having a non-circular outer surface for slidably engaging a corresponding non-circular bore in brake disc 70 to provide for drivingly-connecting the disc 70 to the coupling 56 but allowing some axial sliding movement between the disc 70 and the coupling/sun gear 56, 58.

Transverse partition 32*a*, intermediate the flange 33 and the end face 35, separates the brake assembly 66 from the differential planetary drive mechanism 60. Cavity 31*a* may be at least partially filled with a suitable lubricant which is prevented from escaping into cavity 31*b* by a disc like dam 31*c*, FIG. 4. Referring further to FIG. 4 and also FIG. 6, the planetary gear drive mechanism 60 includes a first carrier member 72 and a second carrier member 74 releasably connected to the carrier member 72 by conventional threaded fastener 75, one shown in FIG. 6. Carrier members 72 and 74 support plural circumferentially spaced apart compound planet gears 78 for rotation on suitable shafts 80, as shown by way of example in FIG. 6. An arrangement of three equally-spaced planet gears 78 is preferred. Compound planet gears 78 each include a first set of gear teeth 82 meshed with cooperating internal gear teeth 84 formed on ring gear 62 and a second set of gear teeth 86 adapted to mesh with internal teeth 88 formed on output ring gear 64, see FIG. 5 also. Planet gears 78 also mesh with sun gear 58 in driven relationship thereto. Accordingly, a substantial speed-reducing torque multiplying effect is provided by the differential planetary gear drive mechanism 60 for rotating the output shaft 34 at a reduced speed with respect to the input shaft or coupling 56 and the motor output shaft 54.

As shown in FIGS. 4 and 5, output ring gear 64 includes a transverse cylindrical disc-like hub portion 65 and a central bore 65*a* therethrough which is adapted to receive a torque limiting clutch hub 90 therein, which hub is drivingly coupled to output shaft 34. In this respect, output shaft 34 has a hexagonal crosssection and is drivenly coupled to hub 90 which has a cooperating hexagonal cross section bore 91 formed therein. Clutch hub 90 is also provided with external threads 93 formed thereon for threadedly connecting the hub to a torque limiting clutch adjustment plate 96 having cooperating internal threads 97, FIG. 5, for threaded engagement with the hub 90.

Referring further to FIG. 5, the torque limiting clutch mechanism connected to ring gear 64 includes spaced apart friction discs 99*a* and 99*b* disposed for forcible engagement with opposite faces of transverse hub 65. Clutch disc 99*a* is also in engagement with a circular flange 90*a* formed on clutch hub 90. A gear 100 is mounted on clutch hub 90, is suitably drivenly connected thereto and is engageable with the other clutch disc 99*b*, as shown. One or more Bellville type springs 102, two shown in FIG. 5, are interposed the gear 100 and the adjustment plate 96 to provide a clutch engagement force acting on a circular web portion 100*a* of gear 100. The clutch discs 99*a* and 99*b*, the flange 90*a*, the hub 65 and web 100*a* to form a torque limiting clutch assembly. Adjustment plate 96 includes a radially extending threaded bore 96*a* formed therein, as shown in FIG. 5, and in which is disposed a setscrew 96*b* having a suitable drive tang 96*d* formed thereon.

If driving torque imposed on ring gear 64 exceeds a limit set by the torque limiting clutch described, the ring gear 64 will slip with respect to the hub 90, rotationally, to prevent damage to the operator unit 30 as well as other structural components including the drive mechanism between the operator unit and the door closure member 14 and any object which may be caught between the door closure member and the floor of the door opening. However, since limit switch gear 100 is keyed for rotation with clutch hub 90, and clutch hub 90 is positively engaged with shaft 34, any slippage of the aforementioned clutch will not result in a loss of timing between a limit switch operably connected to the gear 100 and the position of a door driven by the operator unit 30. By way of example, as shown in FIG. 5, gear 100 is meshed with a pinion 103 which is operably connected to a suitable door position limit switch 105 of a type commercially available from Sanwa Corporation, as Hokuyo model LMP-2, for example.

Referring again to FIG. 6, each of the planet gears 78 is meshed with the sun gear 58 at a respective sets of gear teeth 86 on the planet gears. As previously described, in like manner, the gear teeth 82 of the planet gears 78 are meshed with the teeth 84 of the ring gear 62. As further shown in FIG. 6, ring gear 62 has a set of circumferential external teeth 62*a* formed thereon which are adapted to mesh with a ring gear release block 108, FIGS. 4 and 7, having cooperating teeth 110 formed thereon, FIG. 7, engagable with teeth 62*a* to prevent rotation of the ring gear 62 with respect to the housing 32. In this way, when ring gear 62 is held stationary with respect to housing 32, rotation of motor shaft 54 and coupling/sun gear 56, 58 will effect rotation of ring gear 64 and output shaft 34 at a pre-determined reduced speed with respect to shaft 54.

Accordingly, with brake assembly 66 applied to prevent rotation of motor output shaft 54, operator unit output shaft 34 is also braked against rotation when ring gear 62 is held stationary with respect to housing 32. However, ring gear release block 108 is operable to move out of engagement with ring gear 62 to allow same to rotate freely. Under these conditions, output shaft 34, ring gear 64 and planet gears 78 will rotate together with ring gear 62 even though shaft 54 and coupling/sun gear 56, 58 are held stationary by the brake assembly 66.

Referring further to FIG. 4, ring gear release block 108 is supported in a removable housing 112 secured to the housing 32 by spaced apart fasteners 114, one shown. An elongated lever 116 is pivotally connected to the housing 112 by pivot pin 116*a* and is engageable with an adapter member 117 for moving the release block 108 radially away from engagement with the ring gear 62. A lever actuated switch 120, FIG. 4, includes a lever actuator 122 engagable with a tang 108*b* formed on the release block 108.

Figure 7:
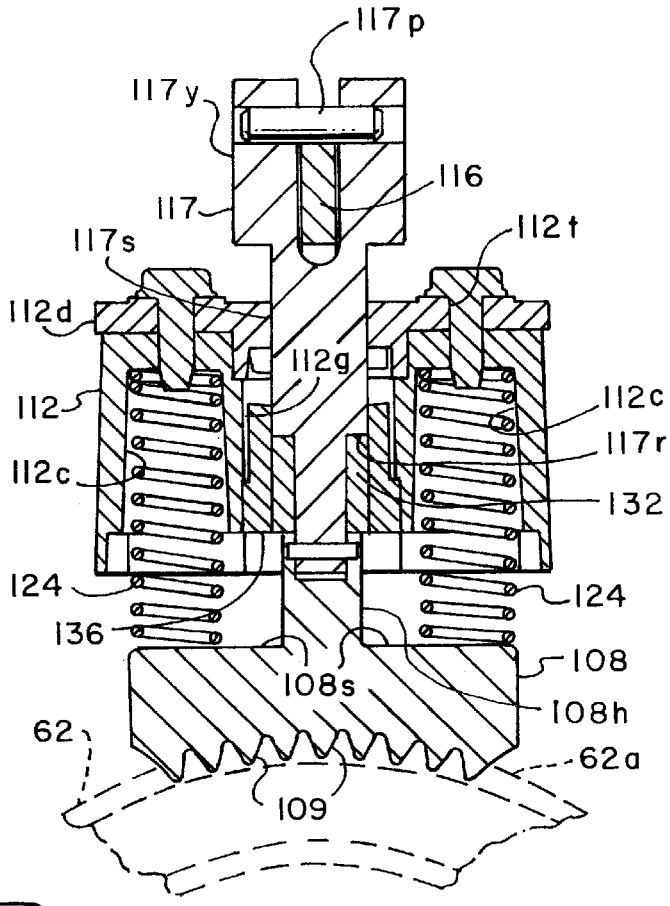
FIG. 7 is a section view taken generally from line 7—7 of FIG. 3 of the release mechanism for the releaseable ring gear.
Figure 7A:
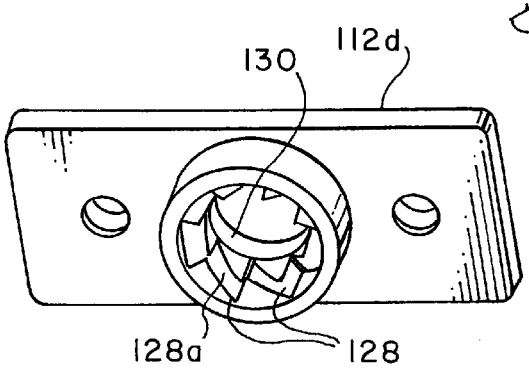
FIG. 7A is a detail perspective view of a cover member for the release mechanism housing.
Figure 8:
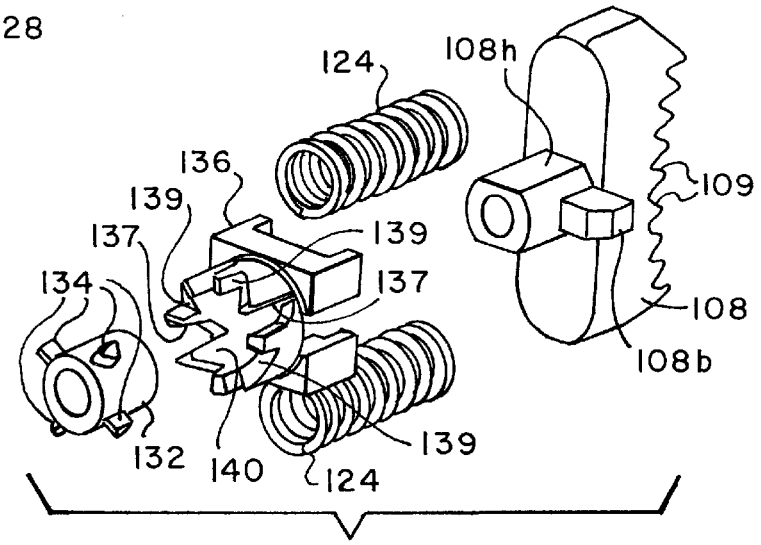
FIG. 8 is a perspective view of certain components of the release mechanism.

Referring now to FIGS. 7, 7A and 8, the ring gear release mechanism further includes spaced-apart coil springs 124 disposed in suitable bores 112*c* formed in housing 112, FIG. 7, and engagable with opposed shoulder portions 108*s* of the release block 108, as shown. Release block adapter member 117 includes a yoke portion 117*y* and a pin 117*p* for engagement by lever 116. Release block adapter 117 is also secured to a hub portion 108*h* for moving the release block 108 against the bias of the springs 124.

A removable housing cover 112*d* is releasably connected to the housing 112 by suitable threaded fasteners 112*t*. As shown in FIG. 7A, housing cover 112*d* includes a plurality of circumferentially spaced, axially projecting and axially sloped teeth 128 formed thereon, spaced about a bore 130 formed in the housing cover and adapted to receive a generally cylindrical axially-extending shank portion 117*s* of the adapter 117. Shank 117*s* also projects into a bore 112*g* formed in housing 112, FIG. 7. An indexing hub 132, FIGS. 7 and 8, is journaled on a reduced diameter portion of shank 117*s* between hub 108*h* and a shoulder 117*r* of shank 117*s*, FIG. 7, and is provided with plural circumferentially spaced indexing cams 134 formed thereon, as shown in FIG. 8.

Cams 134 are operable to engage a member 136 disposed in bore 112*g*, suitably supported by housing 32, and provided with respective sets of cam receiving slots 137 and 139 circumferentially-spaced about a central bore 140 formed in the member 136. Slots 137 and 139 are engagable with the cams 134 to hold the release adapter 117 and release block 108 in selected positions in and out of engagement with the ring gear 62, respectively. In other words, when release block 108 is engaged with ring gear 62 cams 134 are disposed in the slots 137 thereby allowing the block 108 to move axially downward viewing FIG. 7, into engagement with the ring gear.

However, in response to actuation of lever 116 to move adapter 117 and block 108 against the bias of springs 124, upwardly, viewing FIG. 7, the cams 134 engage the teeth 128 and rotatably index the hub 132 into a position such that, when the lever 116 is released and the springs 124 bias the block 108 toward the ring gear 62, the cams 134 register in slots 139 thereby holding the block 108 out of engagement with the ring gear. Upon further actuation of the lever 116 to move the block 108 upwardly, viewing FIG. 7, the cams 134 again engage the teeth 128 and, due to the axially-sloping sides 128*a* of the teeth 128, the hub 132 is rotatably indexed to a position such that the cams 134 will register in slots 137 upon release of the actuator handle 116, thereby allowing the block 108 to re-engage the ring gear 62 to hold same stationary with respect to the housing 32. Accordingly, beginning with the condition wherein the block 108 is engaged with ring gear 62, a first actuation of the handle 116 will effect disengagement of the block 108 from the ring gear 62 and a holding of the block in the disengaged position. Upon a second actuation of the handle 116 and release thereof, the block 108 will re-engage the ring gear 62 holding same against rotation with respect to housing 32.

Under circumstances wherein the brake assembly 66 remains engaged to prevent rotation of shaft 34, coupling/sun gear 56, 58 and the output shaft 34, the output shaft may be allowed to rotate together with all of the elements of the differential planetary gear drive mechanism, except the sun gear 58, on actuation of the release block 108 to disengage from the ring gear 62. This disengagement of the release block 108 from the ring gear 62 may take place manually upon manual actuation of the handle or lever 116 or in response to a control signal applied to an actuator, not shown, suitably connected to the lever. Switch 120 may, of course, be associated with a suitable control system for the operator 30 to maintain a count of the number of actuations of the lever 116 and to indicate the condition of the operator, that is, whether or not the ring gear 62 has been released and allowed to rotate or not.

Figure 9:
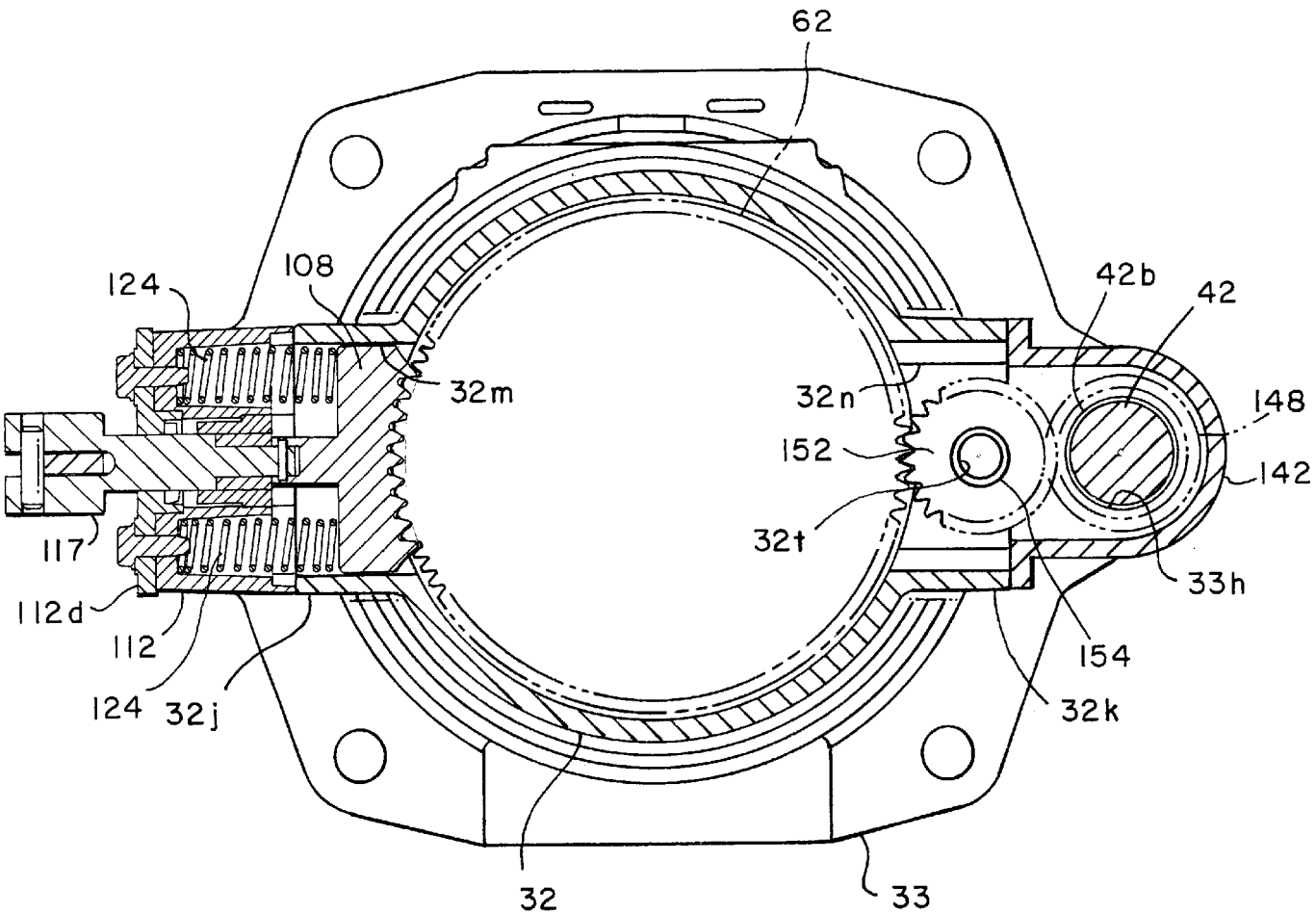
FIG. 9 is a transverse section view through the operator unit taken generally along the line 9—9 of FIG. 3.

Referring now to FIG. 9, the section view of this drawing figure taken through the housing 32 shows opposed mounting flanges 32*j* and 32*k* which are substantially identical and define openings 32*m* and 32*n* adjacent to ring gear 62. In the configuration of FIG. 9, as shown, release block 108 is disposed in cavity 32*m* and housing 112 is secured to the flange 32*j*. The release block 108 and the housing 112 may, however, be disposed in cavity 32*n* and supported on flange 32*k* to provide for reversing the arrangement of the release block and its support structure. More importantly perhaps, one reason for providing the housing 32 with the opposed flanges 32*j* and 32*k* is to provide for arranging the manual or auxiliary drive shaft 42 supported on either side of the housing 32. In the arrangement shown in FIGS. 9 and 10, shaft 42 is supported in a bore 33*h* by a suitable bearing 42*b*. However, shaft 42 and bearing 42*b* may also be disposed in a bore 33*j* for the arrangement wherein manual operation of the operator unit 30 is carried out by placement of the shaft 42 on the opposite side of housing 32.

Figure 10:
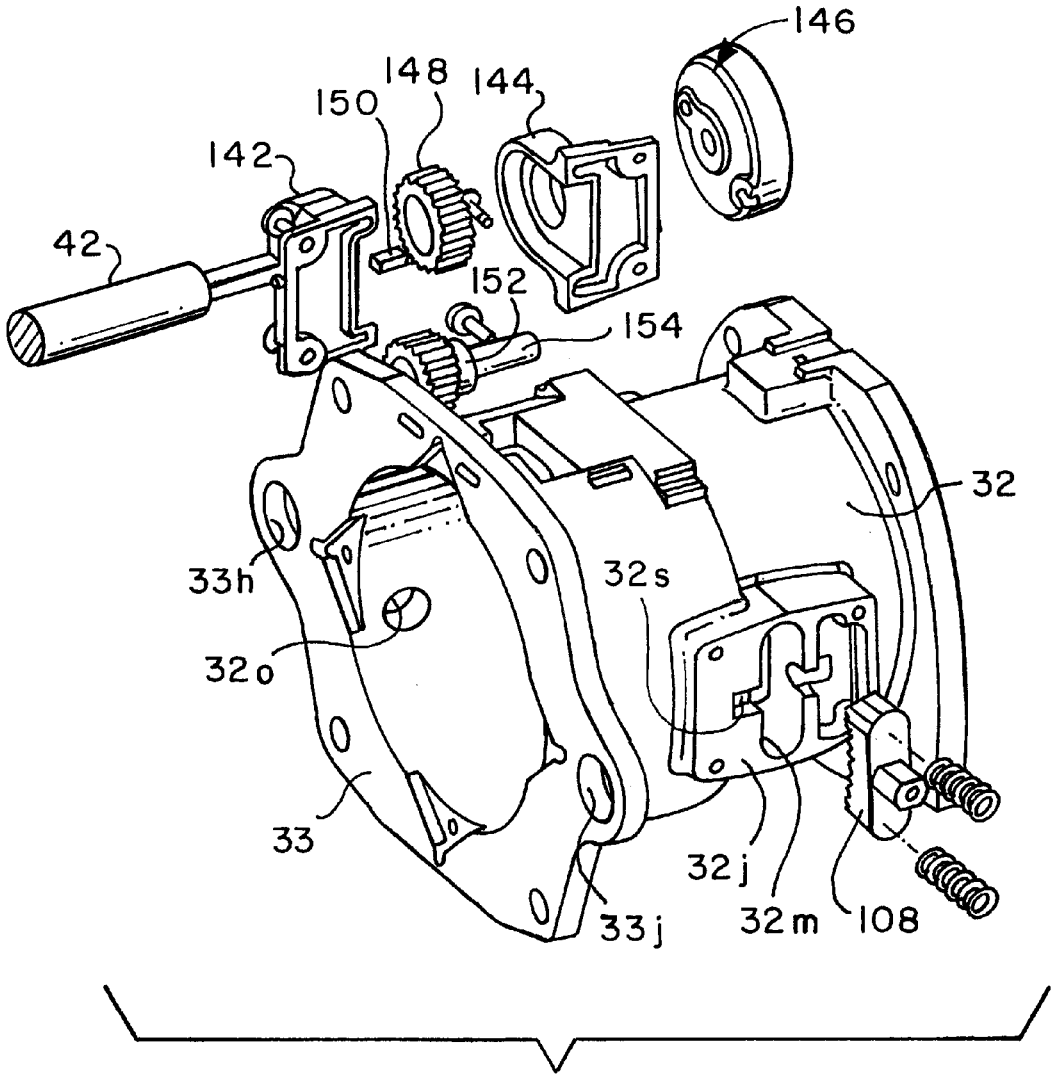
FIG. 10 is an exploded perspective view of certain components of the door operator unit including the manual drivetrain members.

Referring further to FIGS. 9 and 10, the manual or auxiliary powered operating mechanism for raising and/or lowering a door connected to the operator unit 30, includes shaft 42 which is also supported by a two-part housing, including housing members 142 and 144, FIG. 10. Housing members 142 and 144 are adapted to be mounted on the flange 32*k* or 32*j*, depending on which side of the housing 32 the shaft 42 is to be disposed. Shaft 42 is also operably connected to a viscous governor unit 146 of a type commercially available and which is also supported by the housing 144 and operable to retard the rotational speed of the shaft 42 if the ring gear 62 is released to rotate under a force imposed on the shaft 34 due to the weight of a rollup door, for example.

Shaft 42 is operably connected to ring gear 62 by a drive gear 148 adapted to be mounted on shaft 42 and suitably connected thereto for rotation therewith by a key 150. Gear 148 is operable to mesh with an idler gear 152 adapted to be supported on a shaft 154 which may be disposed in a suitable recess 32*s* in cavity 32*m*, FIG. 10 or, as shown in FIG. 9, in a recess 32*t* in cavity 32*n*. Ring gear 62 is adapted to have its teeth 62*a* continually meshed with the teeth of idler gear 152 and idler gear 152 is also meshed with gear 148 drivenly connected to shaft 42. Accordingly, under circumstances wherein a rollup type door, such as the door 14, for example, is in an open position and ring gear 62 is released to allow rotation of shaft 34. Shaft 42 will also be rotated through a drive train comprising the ring gear 62, idler gear 152 and gear 148 mounted for rotation with shaft 42. Downward or closing movement of the door 14 will be retarded by the viscous governor 146.

When it is desired to open the door 14 manually, handwheel 44 is rotated directly, or through endless chain 46 to effect rotation of shaft 34 and the drive mechanism connecting shaft 34 with the door 14, as long as ring gear 62 is disengaged from release block 108. As mentioned previously, the location of the manual or auxiliary drive mechanism comprising the shaft 42, viscous governor 146, housing members 142 and 144, gears 148 and 152 and support shaft 154 may all be located on the opposite side of housing 32 and the location of the release block 108 and its actuating mechanism may also be located on the side opposite from that shown in the exemplary arrangement according to drawing FIGS. 9 and 10, in particular.

The operation of the door operator unit 30 will now be described. Utilizing a suitable control system, not shown in FIGS. 1–10, the motor 48 may be energized substantially simultaneously with energizing the brake 66 to release braking action on disc 70, so that motor shaft 54 may be rotated in one direction or the other, depending on the operation desired. For example, the motor output shaft 54, if operated to effect raising the door 14, would be rotated in one direction while releasing brake 66 and, with ring gear 62 engaged with release block 108, a reduced speed of output shaft 34 would be obtained to drive sprocket 44 and door drum 22 to raise the door.

With the rotation of output shaft 34 and ring gear 64, limit switch gear 100 also rotates pinion 103 to effect operation of the limit switch 105 which, upon reaching a pre-determined limit count, is operable to effect shutoff of motor 48 by way of a suitable control system, not shown. Upon shutoff of motor 48, brake assembly 66 is deenergized and engaged to lock brake disc 70 and shaft 54 as well as coupling/sun gear 56, 58 against rotation and, with ring gear 62 engaged with release block 108, shaft 34 is also arrested and locked against rotation. In the event that door 14 should jam, either during opening or closing movement thereof or an overload condition exists, shaft 34 might be arrested or severely retarded in motion. However, to avoid damage to the drive mechanism of the operator unit 30, ring gear 64 and the differential planetary drive mechanism associated therewith may be allowed to continue to rotate at least briefly, by slipping the clutch formed by the hub 90, the clutch discs 99*a* and 99*b* and the ring gear hub 65.

If the torque limit on the clutch is to be adjusted at any time, setscrew 96*b* may be accessed by a suitable socket head wrench, for example, engageable with drive tang 96*d*, FIG. 5, through a suitable hole 32*o*, FIG. 10, to back the setscrew radially outwardly into engagement with the housing 32 at the hole 32*o* whereupon shaft 34 may be manually rotated in one direction or the other, together with hub 90, while adjustment plate 96 is held stationary to adjust the biasing force of the springs 102. Rotation of the shaft 34 and the hub 90 will occur with respect to the adjustment plate 96 which is being held against rotation by the setscrew 96*b* being disposed in the hole 32*o*.

Once a suitable adjustment has been accomplished, screw 96*b* is re-tightened in engagement with the hub 90 and is moved out of engagement with the housing 32 at the hole 32*o* so that normal operation of the unit 30 may resume. The torque limiting clutch described and shown primarily in FIG. 5 is a preferred feature for the operator unit 30 but the operator unit may be configured such that the hub 90 is integral with or fixed for rotation with the gear 64 and the torque limiting clutch eliminated in certain applications of the operator unit, if desired.

When, for example, the door 14 is in an open position and it is desired to manually close the door either under its own weight or through operation of the manual or auxiliary opening and closing drive mechanism of the operator unit 30, the lever 116 may be actuated to move the release block 108 out of engagement with the ring gear 62. Actuation of the lever 116 to move the block 108 out of engagement with the ring gear 62 will effect holding the ring gear in the disconnected position thanks to the release mechanism described above and illustrated in FIGS. 7, 7A and 8, in particular. With the ring gear 62 free to rotate, any torque on the shaft 34 sufficient to overcome friction in the operator unit 30, which is minimal, will allow shaft 34 to rotate since the planetary drive mechanism 60 will be allowed to rotate with respect to the sun gear 58.

If the weight of door 14 is sufficient to drive the shaft 34 and differential planetary drive mechanism 60 the speed of closing of the door may be controlled by the viscous governor 146, since this governor is being driven with rotation of the ring gear 62, idler gear 152 and drive shaft gear 148, as well as auxiliary drive shaft 42, during closing motion of the door 14. The handwheel drive or auxiliary shaft 42 may, of course, be manually rotated in either direction via the hand wheel sprocket 44 and endless chain 46, or via an alternate power source, not shown, to either open or close the door 14.

A second actuation of lever 116 will effect disengagement of the hub 132 from the short depth slots 139 in the member 136 and allow the release block 108 to reengage with ring gear 62 so that shaft 34 may not turn independent of rotation of the coupler/sun gear 56, 58 which, if braked by the brake assembly 16, will prevent any rotation of output shaft 34.

Those skilled in the art will recognize that the operator unit 30 may be adapted to operate with various types of doors which are either upward acting or horizontally moving, for example. Sectional doors as well as rollup type doors may be controlled by the operator unit 30. By providing the arrangement of the differential planetary drive mechanism 60, the brake assembly 66, the release mechanism provided by the release block 108 and the torque limiting clutch, described and shown herein, an improved door operator unit has been realized. The operator unit 30 may be constructed using conventional engineering materials and components known to those skilled in the art. Certain commercially available components have been described hereinabove by way of example only.

Still further, although a preferred embodiment has been described in detail, those skilled in the art will recognize that various substitutions and modifications may be made without departing from the scope and spirit of the appended claims.

What is claimed is:

1. An apparatus comprising a motor driven door operator unit for moving a door between open and closed positions, said operator unit comprising:

a drive motor including a motor output shaft;

a speed reduction drive mechanism including a housing, a gear drive mechanism supported in said housing and operably connected to said motor output shaft and to an operator output shaft, said drive motor being operable to drive said operator unit output shaft at a reduced speed in opposite directions of rotation, said gear drive mechanism including a sun gear and at least one planet gear operably engaged with said sun gear and with a ring gear;

an adjustable torque limiting clutch disposed between said ring gear and said operator unit output shaft and including means for adjusting a limit torque transferred between said operator unit output shaft and said gear drive mechanism;

a brake assembly operably connected to said motor output shaft and said drive mechanism for braking rotation of said motor output shaft and said operator unit output shaft; and a release member operably connected to said ring gear and operable in a first position to lock said operator unit output shaft against rotation when said brake assembly is engaged, said release member being movable to a second position to allow rotation of said operator unit output shaft independent of said motor output shaft.

2. The apparatus set forth in claim 1 wherein:

said brake assembly comprises an electromagnetic brake unit including a brake member operably connected to said motor output shaft, said brake member being free to rotate with said motor output shaft in response to energizing said brake assembly.

3. The apparatus set forth in claim 2 wherein:

said brake assembly is disposed between said motor output shaft and said gear drive mechanism and is operable to lock said motor output shaft against rotation with respect to said housing.

4. The apparatus set forth in claim 1 including:

a limit switch gear operably connected to said operator unit output shaft and rotatable therewith.

5. An apparatus comprising a motor driven door operator unit for moving a door between open and closed positions, said operator unit comprising:

a drive motor including a motor output shaft;

a speed reduction drive mechanism including a housing, a gear drive mechanism supported in said housing and connected to said motor output shaft and to an operator output shaft, said drive motor being operable to drive said operator unit output shaft at a reduced speed in opposite directions of rotation, said gear drive mechanism comprises a differential planetary gear drive including at least one planet gear operably engaged with a sun gear and with a first ring gear, said first ring gear being operable to be non-rotatable with respect to said housing and a second ring gear engageable with said planet gear and rotatable with respect to said housing and operably coupled to said operator unit output shaft; and a release member operably engaged with said first ring gear to prevent rotation of said first ring gear and said operator unit output shaft when said motor is deenergized, said release member being operable to disengage from said first ring gear to allow rotation of said first ring gear and said operator unit output shaft.

6. The apparatus set forth in claim 5 wherein:

said release member is engageable with a release member position control mechanism including means for holding said release member in a position disengaged from said first ring gear in response to a first actuation of said release member and said release member being operable to reengage with said first ring gear in response to a second actuation of said release member.

7. The apparatus set forth in claim 6 wherein:

said means for holding said release member disengaged from said first ring gear comprises a cam member operably connected to said release member and including cam means thereon engageable with camming teeth on said apparatus for rotatably indexing said cam member so that said cam member may engage cooperating means on said apparatus to hold said release member disengaged from said first ring gear and to permit reengagement of said release member with said first ring gear.

8. The apparatus set forth in claim 5 wherein:

said first ring gear is engaged with an auxiliary drive shaft for manual rotation of said operator unit output shaft in at least one direction when said release member is disengaged from said first ring gear.

9. The apparatus set forth in claim 8 wherein:

said drive shaft includes a governor operably connected thereto for limiting the rotational speed of said operator unit output shaft when said first ring gear is released from engagement with said release member.

10. The apparatus set forth in claim 8 wherein:

said housing includes support means for supporting said release member and said auxiliary drive shaft thereon in selected positions of each and said housing is adapted to reverse the positions of said release member and said auxiliary drive shaft.

11. The apparatus set forth in claim 5 including:

a torque limiting clutch disposed between said drive mechanism and said operator unit output shaft for limiting torque imposed on said drive mechanism.

12. The apparatus set forth in claim 11 wherein:

said torque limiting clutch includes a first hub operably connected to said operator unit output shaft, a second hub operably connected to said drive mechanism, clutch plate means interposed said hubs, spring means operably engaged with said hubs and said clutch plate means for forcibly engaging said hubs with said clutch plate means and an adjustment member for adjusting the bias force of said spring means.

13. A motor driven door operator unit for moving a door between open and closed positions, said operator unit comprising:

a drive motor including a motor output shaft;

a speed reduction drive mechanism including a housing, a gear drive mechanism supported in said housing and connected to said motor output shaft and including an output gear drivably connected to an operator unit output shaft, said drive motor being operable to drive said operator unit output shaft at a reduced speed in opposite directions of rotation;

a brake assembly disposed between said drive motor and said drive mechanism and operably connected to said motor output shaft for braking rotation of said motor output shaft and said operator unit output shaft, said brake assembly including an electromagnetic brake unit including a brake member operably connected to said motor output shaft, said brake member being free to rotate with said motor output shaft in response to energizing said brake assembly;

a release member operably connected to said gear drive mechanism and operable in a first position to lock said operator unit output shaft against rotation when said brake assembly is engaged, said release member being movable to a second position to allow rotation of said operator unit output shaft independent of said motor output shaft;

an adjustable torque limiting clutch disposed between said output gear and said operator unit output shaft for limiting torque imposed on said drive mechanism.

14. An apparatus comprising a motor driven door operator unit for moving a door between open and closed positions, said operator unit comprising:

a drive motor including a motor output shaft;

a speed reduction drive mechanism including a housing, a gear drive mechanism supported in said housing and operably connected to said motor output shaft and to an operator output shaft, said drive motor being operable to drive said operator unit output shaft at a reduced speed in opposite directions of rotation;

a brake assembly operably connected to and disposed between said motor output shaft and said drive mechanism for braking rotation of said motor output shaft and said operator unit output shaft, said brake assembly comprising an electromagnetic brake unit including a brake member operably connected to said motor output shaft, said brake member being free to rotate with said motor output shaft in response to energizing said brake unit, said brake assembly being operable to lock a coupler between said gear drive mechanism and said motor output shaft against rotation with respect to said housing, said coupler including a sun gear, said gear drive mechanism comprising a differential planetary gear drive mechanism including at least one planet gear operably engaged with said sun gear and with a first ring gear, said first ring gear being engageable with said at least one planet gear and operable to be non-rotatable with respect to said housing, and a second ring gear engageable with said at least one planet gear and rotatable with respect to said housing and operably coupled to said operator unit output shaft; and a release member operably connected to said gear drive mechanism and operable in a first position to lock said operator unit output shaft against rotation when said brake assembly is engaged, said release member being movable to a second position to allow rotation of said operator unit output shaft independent of said motor output shaft.

15. The apparatus set forth in claim 14 wherein:

said release member is operably engaged with said first ring gear to prevent rotation of said first ring gear and said operator unit output shaft when said brake assembly is engaged, said release member being operable to disengage from said first ring gear to allow rotation of said first ring gear and said operator unit output shaft.

16. The apparatus set forth in claim 15 wherein:

said release member is engageable with a release member position control mechanism operable for holding said release member in a position disengaged from said first ring gear in response to a first actuation of said release member and said release member being operable to reengage with said first ring gear in response to a second actuation of said release member.

17. The apparatus set forth in claim 16 wherein:

said position control mechanism comprises a cam member operably connected to said release member and including cam means thereon engagable with camming teeth on said apparatus for rotatably indexing said cam member so that said cam member may engage cooperating means on said apparatus to hold said release member disengaged from said first ring gear and to permit reengagement of said release member with said first ring gear.

18. The apparatus set forth in claim 15 wherein:

said first ring gear is engaged with an auxiliary drive shaft for manual rotation of said operator unit output shaft in at least one direction when said release member is disengaged from said first ring gear.

19. The apparatus set forth in claim 18 wherein:

said auxiliary drive shaft includes a governor operably connected thereto for limiting the rotational speed of said operator unit output shaft when said first ring gear is released from engagement with said release member.

20. The apparatus set forth in claim 19 wherein:

said housing includes support means for supporting said release member and said auxiliary drive shaft thereon in selected positions of each and said housing is adapted to reverse the positions of said release member and said auxiliary drive shaft.

21. An apparatus comprising a motor driven door operator unit for moving a door between open and closed positions, said operator unit comprising:

a drive motor including a motor output shaft;

a speed reduction drive mechanism including a housing, a gear drive mechanism supported in said housing and operably connected to said motor output shaft and to an operator output shaft, said drive motor being operable to drive said operator unit output shaft at a reduced speed in opposite directions of rotation;

a brake assembly operably connected to said motor output shaft and said drive mechanism for braking rotation of said motor output shaft and said operator unit output shaft;

a release member operably connected to said gear drive mechanism and operable in a first position to lock said operator unit output shaft against rotation when said brake assembly is engaged, said release member being movable to a second position to allow rotation of said operator unit output shaft independent of said motor output shaft; and a torque limiting clutch disposed between said drive mechanism and said operator unit output shaft for limiting torque imposed on said drive mechanism, said torque limiting clutch including a first hub operably connected to said operator unit output shaft, a second hub operably connected to said drive mechanism, clutch plate means disposed between said hubs, spring means operably engaged with said hubs and said clutch plate means for forcibly engaging said hubs with said clutch plate means and an adjustment member for adjusting the bias force of said spring means.

22. The apparatus set forth in claim 21 including:

a locking mechanism operably connected to said adjustment member and operable to lock said adjustment member in a predetermined position thereof for generating a predetermined bias force by said spring means.

23. The apparatus set forth in claim 22 wherein:

said adjustment member is threadedly engaged with said first hub and operable to be in a selected position with respect to said first hub for providing a predetermined bias force imposed on said torque limiting clutch by said spring means.

24. A motor driven door operator unit for moving a door between open and closed positions, said operator unit comprising:

a drive motor including a motor output shaft;

a speed reduction drive mechanism including a housing, a gear drive mechanism supported in said housing and connected to said motor output shaft and to an operator unit output shaft, said drive motor being operable to drive said operator unit output shaft at a reduced speed in opposite directions of rotation;

a brake assembly interposed said drive motor and said drive mechanism and operably connected to said motor output shaft for braking rotation of said motor output shaft and said operator unit output shaft, said brake assembly including an electromagnetic brake unit including a brake member operably connected to said motor output shaft, said brake member being free to rotate with said motor output shaft in response to energizing said brake assembly;

a release member operably connected to said gear drive mechanism and operable in a first position to lock said operator unit output shaft against rotation when said brake assembly is engaged, said release member being movable to a second position to allow rotation of said operator unit output shaft independent of said motor output shafts; and a torque limiting clutch disposed between said drive mechanism and said operator unit output shaft for limiting torque imposed on said drive mechanism, said torque limiting clutch including a first hub operably connected to said operator unit output shaft, a second hub operably connected to said drive mechanism, clutch plate means interposed said hubs, spring means operably engaged with said hubs and said clutch plate means for forcibly engaging said hubs with said clutch plate means and an adjustment member for adjusting the bias force of said spring means.

25. A motor driven door operator unit for moving a door between open and closed positions, said operator unit comprising:

a drive motor including a motor output shaft;

a speed reduction drive mechanism including a housing, a gear drive mechanism supported in said housing and connected to said motor output shaft and to an operator unit output shaft, said drive motor being operable to drive said operator unit output shaft at a reduced speed in opposite directions of rotation;

a brake assembly interposed said drive motor and said drive mechanism and operably connected to said motor output shaft for braking rotation of said motor output shaft and said operator unit output shaft, said brake assembly including an electromagnetic brake unit including a brake member operably connected to said motor output shaft, said brake member being free to rotate with said motor output shaft in response to energizing said brake assembly;

a release member operably connected to said gear drive mechanism and operable in a first position to lock said operator unit output shaft against rotation when said brake assembly is engaged, said release member being movable to a second position to allow rotation of said operator unit output shaft independent of said motor output shaft, said release member being engageable with a release member position control mechanism including means for holding said release member in a position disengaged from a member of said drive mechanism in response to a first actuation of said release member and said release member being operable to reengage with said member of said drive mechanism in response to a second actuation of said release member; and a torque limiting clutch disposed between said drive mechanism and said operator unit output shaft for limiting torque imposed on said drive mechanism.

26. The apparatus set forth in claim wherein:

said means for holding said release member disengaged comprises a cam member operably connected to said release member and including cam means thereon engageable with camming teeth on said apparatus for rotatably indexing said cam member so that said cam member may engage cooperating means on said apparatus to hold said release member disengaged and to permit reengagement of said release member with said member of said drive mechanism.

27. An apparatus comprising a motor driven door operator unit for moving a door between open and closed positions, said operator unit comprising:

a drive motor including a motor output shaft;

a speed reduction drive mechanism including a housing, a gear drive mechanism supported in said housing and operably connected to said motor output shaft and to an operator output shaft, said drive motor being operable to drive said operator unit output shaft at a reduced speed in opposite directions of rotation, said gear drive mechanism comprising a planetary gear drive including at least one planet gear operably engaged with a sun gear and with a ring gear, said ring gear being operable to be non-rotatable with respect to said housing, a release member operably connected to said gear drive mechanism and operable in a first position to lock said ring gear against rotation, said release member being movable to a second position to allow rotation of said ring gear and said operator unit output shaft; and an auxiliary drive shaft operably connected to said ring gear and drivably connected to said operator unit output shaft through said ring gear when said release member is in said second position.

28. The apparatus set forth in claim 27 including:

a governor operably connected to said auxiliary drive shaft for limiting the rotational speed of said operator unit output shaft when said release member is in said second position.

* * * * *